US007176777B2

(12) United States Patent
Hsueh et al.

(10) Patent No.: US 7,176,777 B2
(45) Date of Patent: Feb. 13, 2007

(54) TRANSFORMER AND LAMP DRIVING SYSTEM UTILIZING THE SAME

(75) Inventors: Ching-Fu Hsueh, Bade (TW); Wan-Chin Hsu, Dasi Township, Taoyuan County (TW); Chih-Shin Huang, Taoyuan (TW)

(73) Assignee: Darfon Electronics Corp., Taoyuan (TW)

( * ) Notice: Subject to any disclaimer, the term of this patent is extended or adjusted under 35 U.S.C. 154(b) by 22 days.

(21) Appl. No.: 11/087,548

(22) Filed: Mar. 24, 2005

(65) Prior Publication Data

US 2005/0212637 A1 Sep. 29, 2005

(30) Foreign Application Priority Data

Mar. 25, 2004 (TW) ..... 93108201 A

(51) Int. Cl.
*H01F 27/24* (2006.01)

(52) U.S. Cl. ..... 336/208; 336/198; 336/212

(58) Field of Classification Search ..... 336/208, 336/198, 192, 212
See application file for complete search history.

(56) References Cited

U.S. PATENT DOCUMENTS

| | | | | |
|---|---|---|---|---|
| 6,424,247 | B2 * | 7/2002 | Suzuki | 336/110 |
| 2002/0121955 | A1 * | 9/2002 | Yeh et al. | 336/198 |
| 2004/0046512 | A1 * | 3/2004 | Suzuki et al. | 315/291 |
| 2004/0130426 | A1 * | 7/2004 | Suzuki | 336/212 |

FOREIGN PATENT DOCUMENTS

| | | | |
|---|---|---|---|
| JP | 06163160 A | * | 6/1994 |
| JP | 10149932 A | * | 6/1998 |

* cited by examiner

*Primary Examiner*—Anh Mai
(74) *Attorney, Agent, or Firm*—Rabin & Berdo, P.C.

(57) ABSTRACT

A transformer includes a bobbin, a first magnetic core, a first and a second coils and a second magnetic core. The first magnetic core is disposed in the bobbin. The first coil and the second coil respectively wind around the bobbin. The second magnetic core covers at the exterior of the bobbin. A main magnetic flux is formed between the first magnetic core and the second magnetic core. A lamp driving system includes the above-mentioned transformer and a lamp. The first coil is input by a first voltage signal, the second coil is induced to generate a second voltage signal, and the lamp is driven by the second voltage signal.

19 Claims, 9 Drawing Sheets

500

700

TRANSFORMER AND LAMP DRIVING SYSTEM UTILIZING THE SAME

This application claims the benefit of Taiwan application Serial No. 93108201, filed Mar. 25, 2004, the subject matter of which is incorporated herein by reference.

BACKGROUND OF THE INVENTION

1. Field of the Invention

The invention relates in general to a transformer, and more particularly to a transformer applied in a lamp driving system.

2. Description of the Related Art

Along with the coming multi-media era, liquid crystal displays (LCD) have increasingly been applied to the products, such as computer monitors and LCD TVs. Generally, the LCD utilizing a light and high-performance lamp driving system to generate backlight has advantages of having a thin body and displaying clear/stable pictures. The lamp driving system in a LCD is mainly composed of a discharge lamp, such as a cold cathode fluorescent lamp (CCFL), and a transformer for driving the CCFL.

Referring to FIG. 1A and FIG. 1B at the same time, an exploded view of a conventional transformer and a combined view of the conventional transformer are respectively shown. The conventional transformer 100 is used to drive the CCFL in a LCD. The transformer 100 includes a bobbin 102, a first E-shape magnetic core 104 and a second E-shape magnetic core 106.

The primary side coil and the secondary side coil (not shown in the figure) are wound around the bobbin 102, and two ends of the bobbin 102 have a number of metal pins 108 for connecting to the primary side coil and the secondary coil and welding to a circuit board.

The first E-shape magnetic core 104 and the second E-shape magnetic core 106 are combined together along the direction shown by the arrow in FIG. 1A to become a combined transformer 100 as shown in FIG. 1B. The combined first and second E-shape magnetic cores 104 and 106 respectively generate a magnetic flux in the exterior and the interior of the bobbin 102.

Referring to FIG. 2, a vertical view of the conventional transformer 100 is shown. The bobbin 102 of the transformer 100 is not shown in FIG. 2 to clarify the figure. From the figure, it can be seen that the first E-shape magnetic core 104 and the second E-shape magnetic core 106 are combined together. The primary side coil 210 and the secondary side coil 212 are wound around the bobbin. That is, the primary side coil 210 and the secondary side coil 212 are respectively wound around the central parts of the first E-shape magnetic core 104 and the second E-shape magnetic core 106.

When an alternating voltage signal is input to the primary side coil 210, the magnetic flux is generated in the combined first and second E-shape magnetic cores 104 and 106 as shown by the dotted lines in the figure. Due to induction of the magnetic flux, another alternating voltage signal is output from the secondary side coil 212, which is utilized to drive the CCFL.

The lamp driving system of a LCD is generally covered by a metal housing to prevent the EMI it generates from interfering with the LCD panel. However, due to the tendency of LCD to be thin, the distance between the metal housing and the transformer 100 is quite small.

In the conventional transformer 100, as shown by the dotted line in FIG. 2, the magnetic flux generated by inputting an alternating voltage signal to the primary side coil 210 and originally exiting in the first E-shape magnetic coil 104 and the second E-shape magnetic coil 106, is partially spread to the metal housing, thereby causing the flux leakage and magnetic flux loss of the transformer 100 due to inadequate distance between the metal housing and the transformer 100. The magnetic flux loss of the transformer 100 will increase the loading effect and cause the bobbin current not easily balanced, the voltage signal output by the secondary side coil 212 unstable, and the CCFL driven by the transformer 100 to illuminate unstably, thereby influencing the display quality of the LCD.

SUMMARY OF THE INVENTION

It is therefore an object of the invention to provide a transformer applied to a lamp driving system of a LCD, which can prevent flux leakage generated as driving the CCFL. Therefore, the CCFL for illuminating the LCD panel can emits light stably and the whole quality of the LCD can be thus improved.

The invention achieves the above-identified object by providing a transformer including a bobbin, a first magnetic core, a first and a second coils and a second magnetic core. The first magnetic core is disposed in the bobbin. The first coil and the second coil respectively wind around the bobbin. The second magnetic core covers at the exterior of the bobbin. A main magnetic flux is formed between the first magnetic core and the second magnetic core.

In the above-mentioned transformer, the first magnetic core can be a bar-like magnetic core. The second magnetic core can be a plate-like magnetic core and the second magnetic core has an approximate C shape. The two ends of the second magnetic core have respective hollow parts, and the second magnetic core is combined with the first magnetic core via the hollow parts.

In addition, in the above-mentioned transformer, the first coil is a primary side coil and the second coil is a secondary side coil. The transformer further includes a third coil winding around the bobbin, the second coil and the third coil are located respectively at two sides of the first coil, and the second coil and the third coil have almost the same winding number. The first coil is a primary side coil while the second coil and the third coil are secondary coils.

Other objects, features, and advantages of the invention will become apparent from the following detailed description of the preferred but non-limiting embodiments. The following description is made with reference to the accompanying drawings.

DETAILED DESCRIPTION OF THE INVENTION

A preferred embodiment is taken for illustrating the invention in detail, however, the scope of the invention is not limited thereto. The embodiment only provides a kind of transformer under the spirit of the invention. In the following, the skill feature of the invention is described in detail first.

Figure 1A:
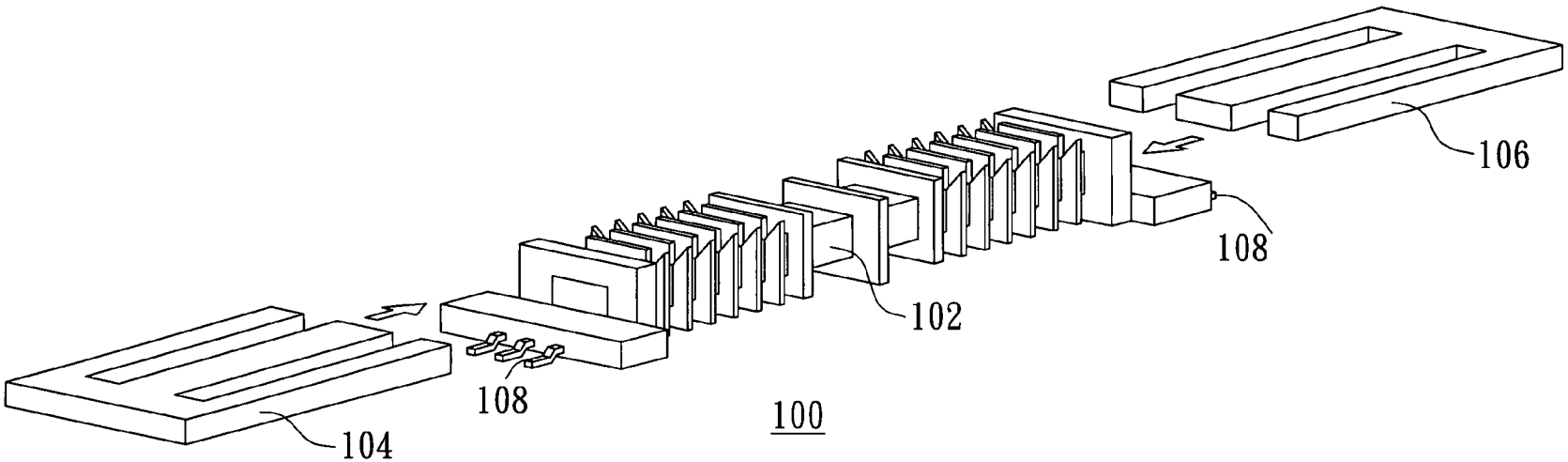
FIG. 1A(PRIOR ART)
FIG. 1A is an exploded view of a conventional transformer.
Figure 1B:
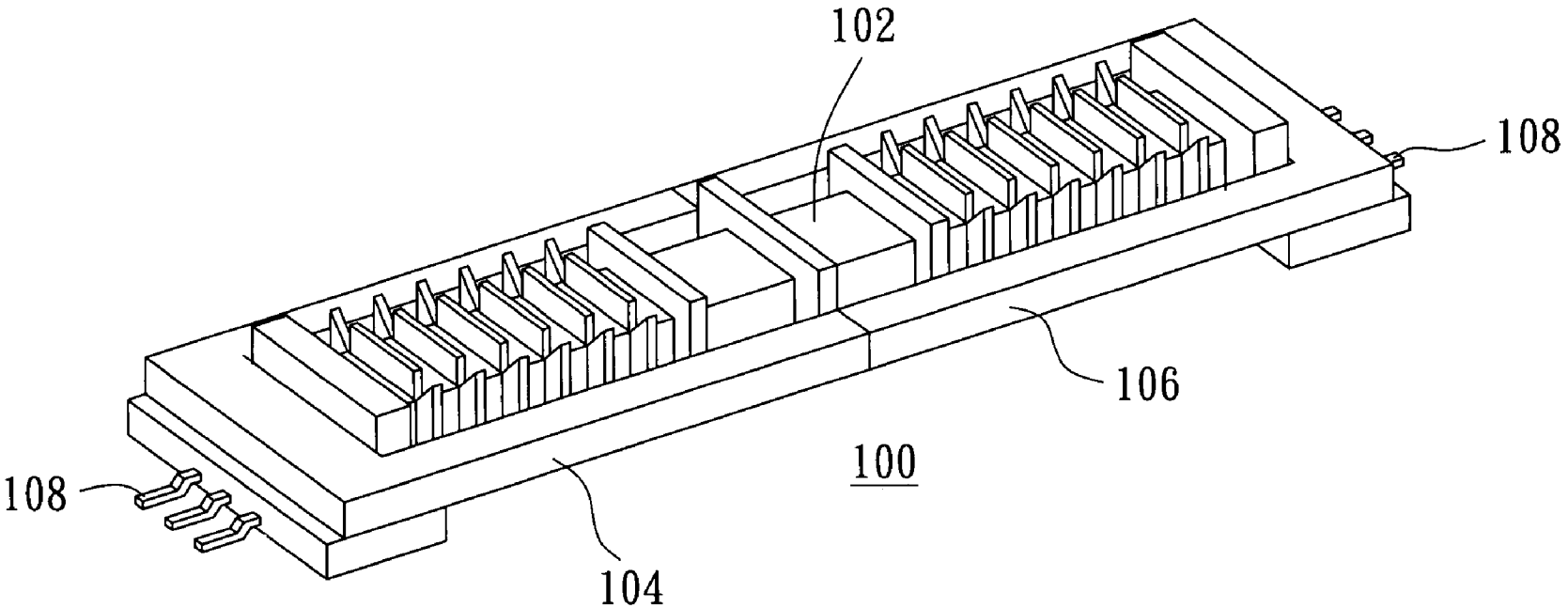
FIG. 1B(PRIOR ART)
FIG. 1B is a combined view of the conventional transformer.
Figure 2:
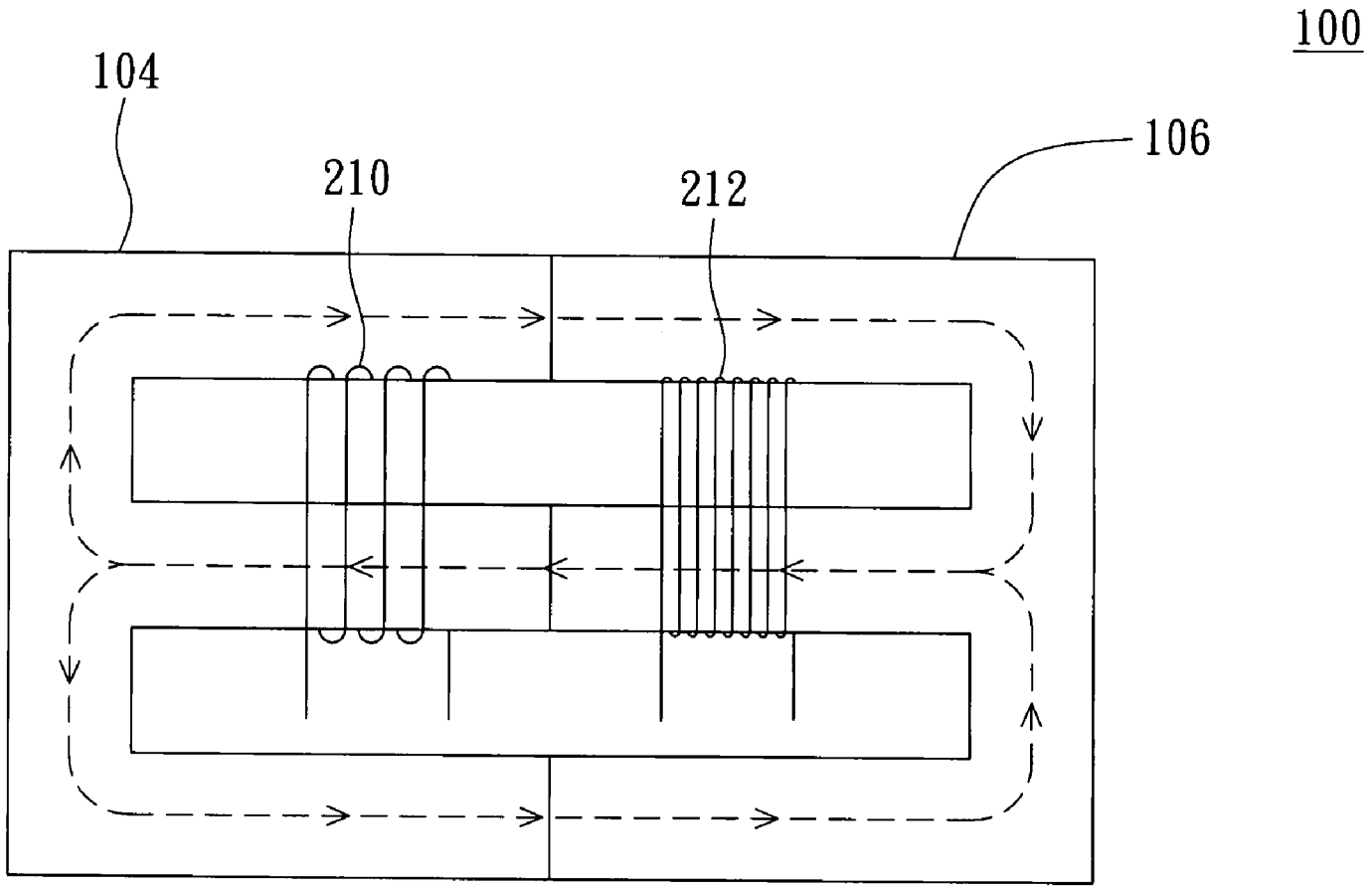
FIG. 2(PRIOR ART)
FIG. 2 is a vertical view of the conventional transformer.
Figure 3A:
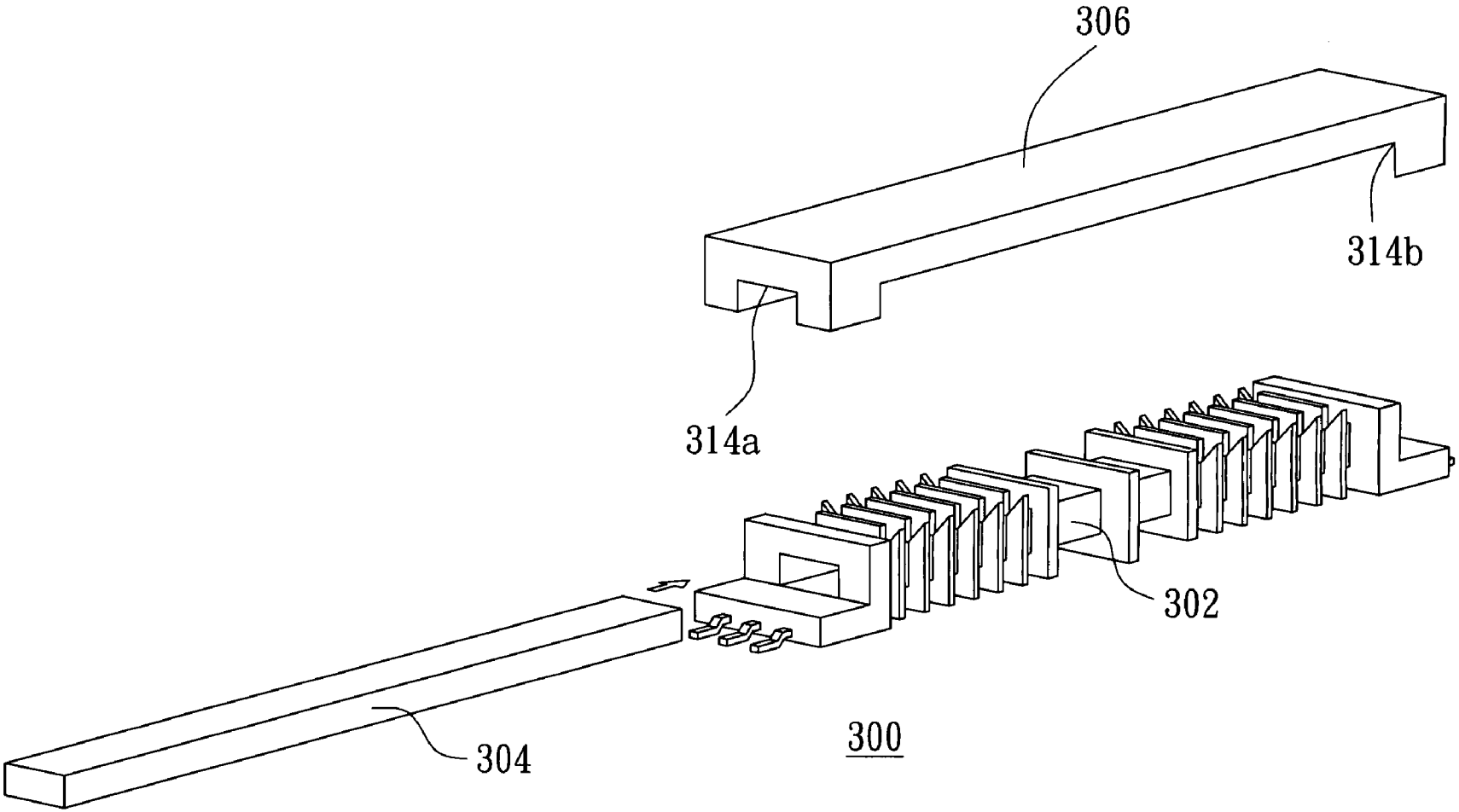
FIG. 3A is an exploded view of the transformer according to the invention.
Figure 3B:
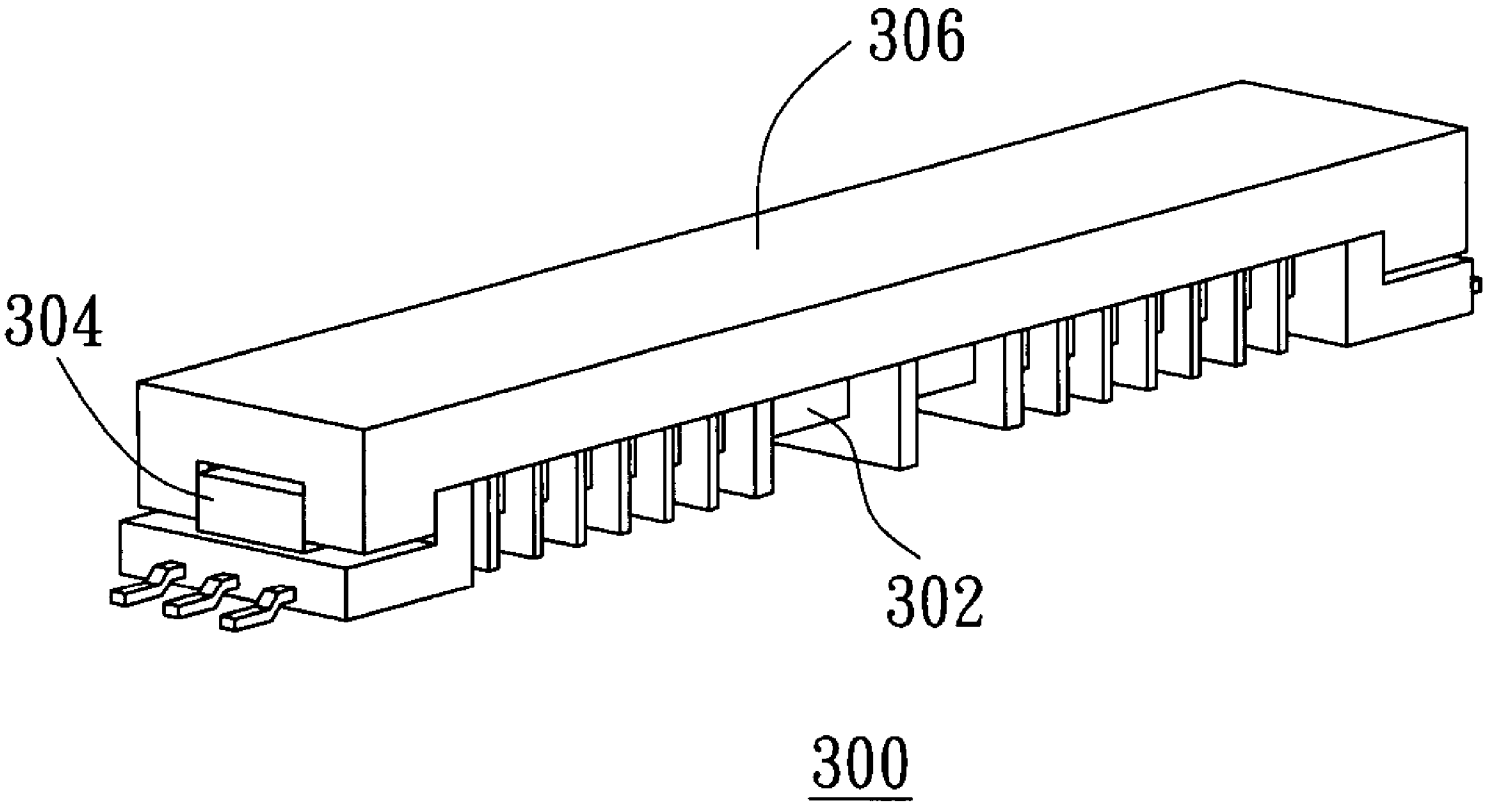
FIG. 3B is an exploded view of the transformer according to the invention.

Referring to FIG. 3A and FIG. 3B simultaneously, an exploded view of the transformer according to the invention and a combined view of the transformer according to the invention are respectively shown. The transformer 300 of the invention is used to drive the CCFL of a LCD. The transformer 300 includes a bobbin 302, a first magnetic core 304, a second magnetic core 306, and a first and a second coils (not shown in the figure).

As shown in FIG. 3A, the first magnetic core 304 is a bar-like magnetic core while the second magnetic core 306 is a plate-like magnetic core. Moreover, the plate-like second magnetic core 306 has an approximate C shape. The two ends of the second magnetic cores 306 have respectively hollow parts 314*a* and 314*b*. A number of metal pines 308 are disposed at two ends of the bobbin 302 for connecting to the first coil and the second coil and welding to a circuit board.

The first and the second coils are wound around the bobbin 302. The first magnetic core 304 can be inserted and disposed into the bobbin 302 along the direction shown by the arrow of FIG. 3A. The second magnetic core 306 is wound in the exterior of the bobbin 302. Furthermore, the plate-like second magnetic core 306 is combined with the bar-like first magnetic core 304 via the hollow parts 314*a* and 314*b*. The combined transformer 300 is illustrated in FIG. 3B.

Figure 4:
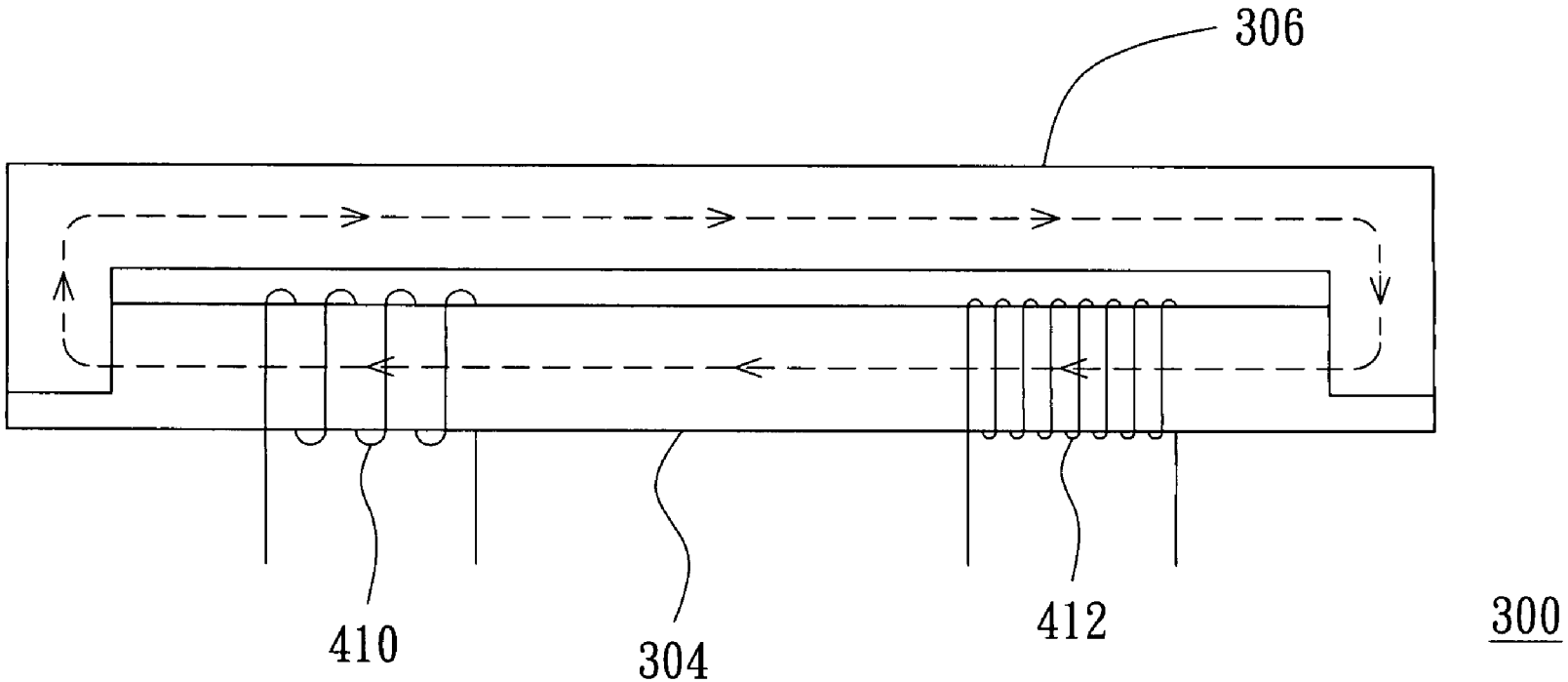
FIG. 4 is a front view of the transformer in the invention.

Referring to FIG. 4, a front view of the transformer 300 in the invention is shown. The bobbin 302 of the transformer 300 is not shown in FIG. 4 to clarify the figure. From the figure, it can be seen clearly that the plate-like second magnetic core 306 covers at the exterior of the bar-like first magnetic core 304. The first coil 410, which can be used as a primary side coil, and the second coil 412, which can be used as a second side coil, are respectively wound around the bobbin. That is, the first coil 410 and the second coil 412 are wound around the first magnetic core 304.

When an alternating first voltage signal is inputted to the first coil 410 used as a primary side coil, a main magnetic flux is generated between the first magnetic core 304 and the second magnetic core 306 as shown by the dotted lines in the figure. Due to the induction of the magnetic flux, an alternating second voltage signal is output from the second coil 412 used as a secondary side coil. That is, the second coil 412 is induced to generate the second voltage signal by the first coil 410 and the first voltage signal. The second voltage signal generated by the second coil 412 is used to drive the lamp.

Figure 5:
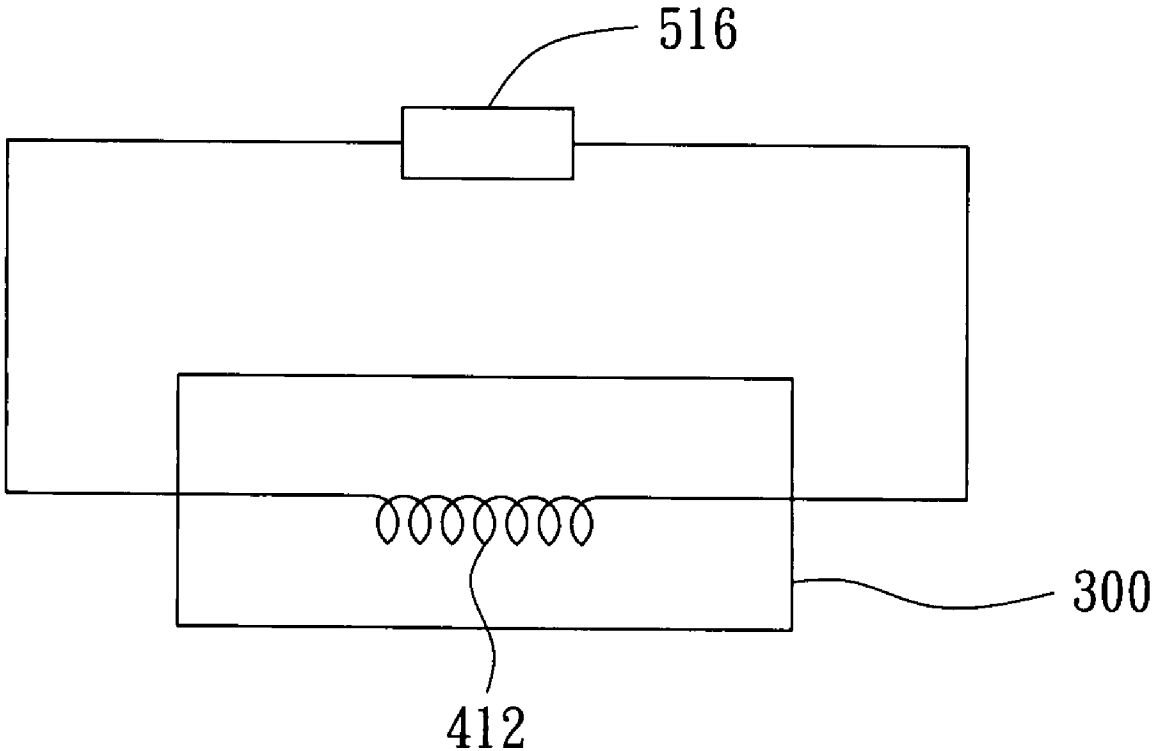
FIG. 5 is a schematic diagram of the lamp driving system in the invention.

Referring to FIG. 5, a schematic diagram of the lamp driving system in the invention is shown. The lamp driving system 500 of the invention includes the above-mentioned transformer 300 and a lamp 516. The transformer 300 having only the second coil 412 used as the secondary side coil is illustrated in FIG. 5 to clarify the figure. The lamp 516 is coupled to the second coil 412, and the lamp 516 is driven by the second voltage signal. In the above-mentioned lamp driving system 500, the lamp 516 can be a discharge lamp, such as a CCFL.

Figure 6:
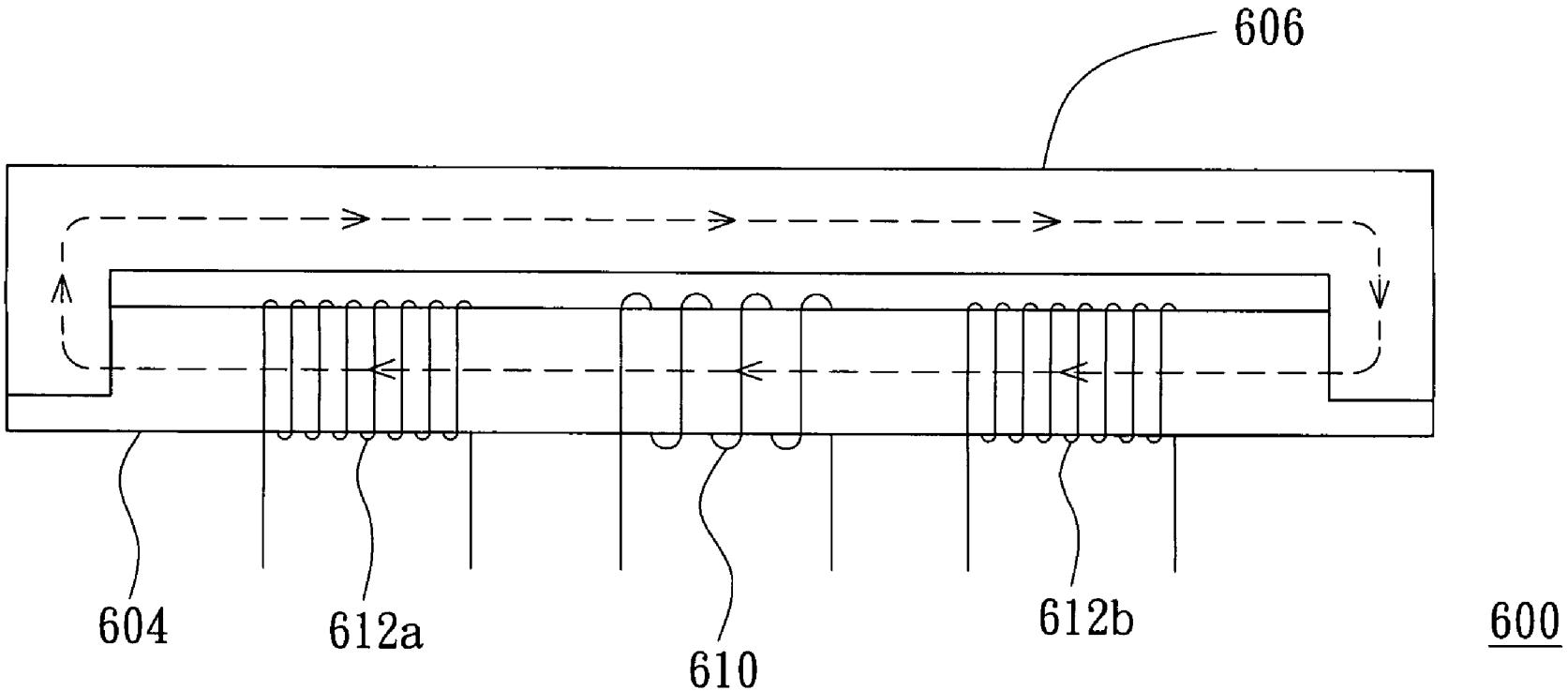
FIG. 6 is a schematic diagram of another transformer in the invention.

Referring to FIG. 6, a schematic diagram of another transformer in the invention is shown. The transformer 600 has the same structure with the above-mentioned transformer 300 except for wounding cores. In the transformer 600, the secondary side coil includes a second coil 612*a* and a third coil 612*b*. The second coil 612*a* and the third coil 612*b* are wound around the bobbin. Furthermore, the second coil 612*a* and the third coil 612*b* are disposed respectively at two sides of the first coil 610 used as a primary side coil. The second coil 612*a* and the third coil 612*b* have approximately the same winding number.

Similar to the case of the transformer 300, in the transformer 600, when an alternating first voltage signal is input to the first coil 610 used as a primary side coil, a main magnetic flux is generated between the first magnetic core 604 and the second magnetic core 606 as shown by the dotted lines in the figure. Due to the induction of the magnetic flux, the second coil 612*a* and the third coil 612*b* respectively output an alternating second voltage signal and an alternating third voltage signal. That is, the second and the third coils 612*a* and 612*b* are respectively induced to generate the second and the third voltage signals by the first coil 610 and the first voltage signal. The second and the third voltage signals generated by the secondary side coil can be used to drive the lamp.

According to usage requirement of the LCD, the transformer is sometimes used to drive the lamp of higher luminance. In this case, the lamp needs to be driven by a higher voltage. The second coil and the third coil used as a secondary side coil of the transformer can be wound around the bobbin in opposite directions. As a result, when the alternating first voltage signal is input to the first coil used as a primary side coil, the second coil and the third coil used as a secondary side coil output respectively an alternating second voltage signal and an alternating third voltage signal in opposite directions, and the output second and the third voltage signals can thus be superposed to drive the lamp of higher luminance.

Using the method of circling two secondary side coils and inputting the first voltage signal to the first coil used as the primary coil, the test shows that in the conventional transformer 100, a quite large voltage difference happens between the first E-shape magnetic core 104 and the second E-shape magnetic core 106. Therefore, good insulating material should be applied to the joint of the first E-shape magnetic core 104 and the second E-shape magnetic core 106 to prevent two cores contacting and discharging electricity.

However, as compared with the conventional transformer 100, in the same test conditions, the voltage difference between the first magnetic core 604 and the second magnetic core 606 of the transformer 600 is quite small. Therefore, it is not required to insulate the joint of the first magnetic core 604 and the second magnetic core 606. In the manufacturing process, no extra insulating process is required for the transformer of the invention, thereby reducing not only the material cost but also the time of manufacturing a transformer.

Figure 7:
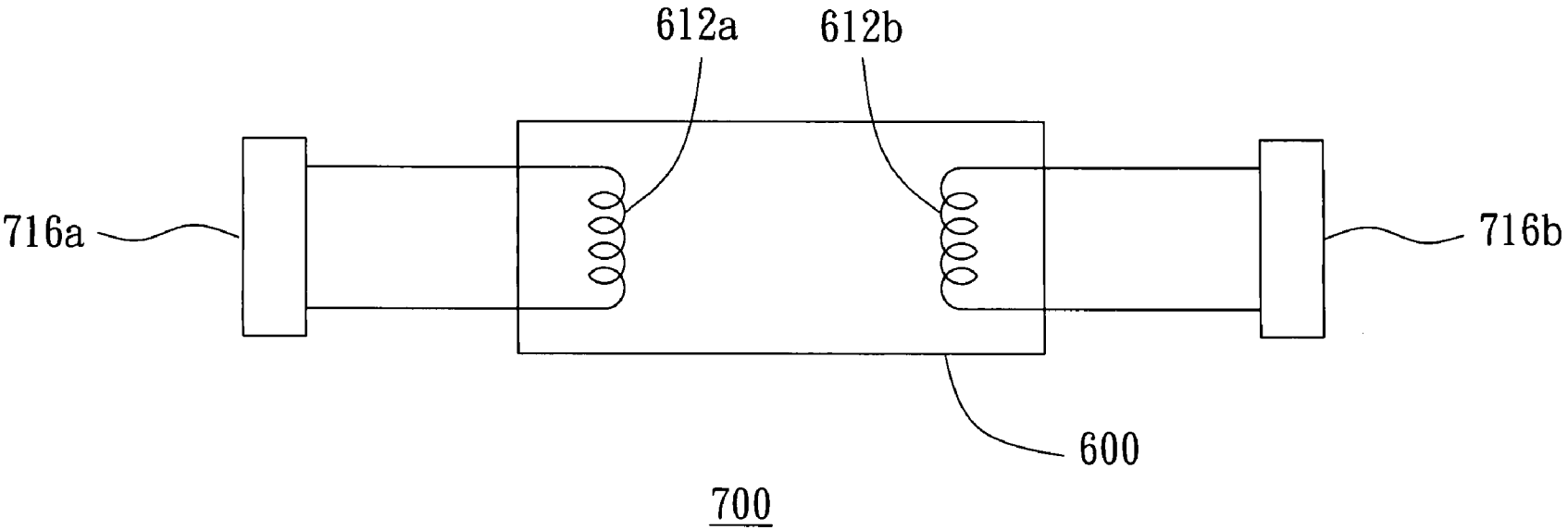
FIG. 7 is a schematic diagram of another lamp driving system in the invention.

Referring to FIG. 7, a schematic diagram of another lamp driving system in the invention is shown. Similar to the lamp driving system 500, the lamp driving system 700 includes a transformer 600 and lamps 716*a*, 716*b*. Similarly, the transformer 600 is shown to have only a second coil 612*a* and a third coil 612*b* used as the secondary side coils in FIG. 7.

The lamps 716*a* and 716*b* are respectively coupled to the second and the third coils 612*a* and 612*b*, and driven by the second and the third voltage signals. In the above-mentioned lamp driving system 700, the lamps 716*a* and 716*b* can be discharge lamps, such as CCFLs.

Furthermore, for the two secondary side coils 612*a* and 612*b* use the same magnetic core (the first magnetic core 604) and have the same winding number, the terminals of the two secondary side coils coupled to the CCFL have the same polarity. According to Faraday's electromagnetic induction law and Lenz law, the magnetic fluxes of the two secondary side coils have the same magnitude and direction. Therefore, the current flowing through the CCFL can be automatically balanced without using extra balancing circuits.

In the above-mentioned embodiment of the invention, the transformers 300 and 600 have different number of winding coils for respectively driving a single CCFL or several CCFLs to emit light. Referring to FIG. 4 and FIG. 6, the magnetic core of the transformer 300 (or the transformer 600) is composed of the bar-like first magnetic core 304 (or 604) and the plate-like second magnetic core 306 (or 606) covering at the exterior of the first magnetic core 304 (or 604). The magnetic flux represented by dotted lines forms a main magnetic flux between the first magnetic core 304 (604) and the second magnetic core 306 (606).

The plate-like second magnetic core 306 (606) is disposed such that the magnetic flux goes from the first magnetic core 304 (604) and passes the second magnetic core 306 (606) to form the main magnetic flux. Therefore, even if a metal housing is covered on the lamp driving system of the LCD, the main magnetic flux will be confined in the second magnetic core 306 (606) and no magnetic flux is spread to the metal housing to generate flux leakage of the transformer 300 (600) and cause the magnetic flux loss. Consequently, the transformer 300 of the invention has a lower loading effect. In addition to low loading effect, the transformer 600 has the function of balancing bobbin current, and stabilizing the voltage signal output by the secondary side coil as well as illumination of the CCFL driven by the transformer 300 (600), thereby improving LCD quality.

Moreover, compared with the conventional transformer, the transformer of the invention can save the cost of insulating material and reduce manufacturing time due to no requirement of insulating the joint of the first E-shape magnetic core and the second magnetic core.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A transformer, comprising:

a bobbin having a top, lateral sides and a bottom;

a first magnetic core, disposed in the bobbin;

a first coil and a second coil, respectively winding around the bobbin; and a second magnetic core having opposite longitudinal ends, covering the bobbin, the second magnetic core having a flat body, without any opening within its outer boundary, disposed over the top of the bobbin so as to completely cover the top of the bobbin, wherein a main magnetic flux is formed between the first magnetic core and the second magnetic core and confined in the second magnetic core without flux leakage, the second magnetic core extending at the opposite longitudinal ends downward toward the bottom into opposition to the sides.

2. The transformer according to claim 1, wherein the first magnetic core is a bar-like magnetic core.

3. The transformer according to claim 1, wherein the second magnetic core has an approximate C shape.

4. The transformer according to claim 1, wherein the two ends of the second magnetic core have respective hollow parts, and the second magnetic core is combined with the first magnetic core via the hollow parts.

5. The transformer according to claim 1, wherein the first coil is a primary side coil and the second coil is a secondary side coil.

6. The transformer according to claim 1, wherein the transformer further comprises a third coil winding around the bobbin, the second coil and the third coil are located respectively at two sides of the first coil, and the second coil and the third coil have almost the same winding number.

7. The transformer according to claim 6, wherein the first coil is a primary side coil while the second coil and the third coil are secondary coils.

8. A lamp driving system, comprising:

a transformer, comprising:

a bobbin having a top, lateral sides and a bottom;

a first magnetic core, disposed in the bobbin;

a first coil and a second coil, respectively winding around the bobbin, wherein the first coil is for receiving a first voltage signal, and the second coil is induced to generate a second voltage signal by the first coil and the first voltage signal; and a second magnetic core having opposite longitudinal ends, covering the bobbin, the second magnetic core having a flat body, without any opening within its outer boundary, disposed over the top of the bobbin so as to completely cover the top of the bobbin, wherein a main magnetic flux is formed between the first magnetic core and the second magnetic core and confined in the second magnetic core without flux leakage, the second magnetic core extending at the opposite longitudinal ends downward toward the bottom into opposition to the sides; and a lamp, coupled to the second coil and driven by the second voltage signal.

9. The lamp driving system according to claim 8, wherein the first magnetic core is a bar-like magnetic core.

10. The lamp driving system according to claim 8, wherein the second magnetic core has an approximate C shape.

11. The lamp driving system according to claim 8, wherein the two ends of the second magnetic core have respective hollow parts, and the second magnetic core is combined with the first magnetic core via the hollow parts.

12. The lamp driving system according to claim 8, wherein the lamp is a discharge lamp.

13. The lamp driving system according to claim 12, wherein the discharge lamp is a cold cathode fluorescent lamp (CCFL).

14. A lamp driving system, comprising:

a transformer, comprising:

a bobbin having a top, lateral sides and a bottom;

a first magnetic core, disposed in the bobbin;

a first coil, winding around the bobbin;

a second coil and a third coil, winding around the bobbin and respectively located at two sides of the first coil, wherein the second coil and the third coil have almost the same winding number; and a second magnetic core having opposite longitudinal ends, covering the bobbin, the second magnetic core having a flat body, without any opening within its outer boundary, disposed over the top of the bobbin so as to completely cover the top of the bobbin, wherein a main magnetic flux is formed between the first magnetic core and the second magnetic core and confined in the second magnetic core without flux leakage, the second magnetic core extending at the opposite longitudinal ends downward toward the bottom into opposition to the sides; and a first lamp and a second lamp, respectively coupled to the second coil and the third coil, wherein the first coil is for receiving a first voltage signal, the second coil and the third coil are induced to generate a second voltage signal and a third voltage signal by the first coil and the first voltage signal, and the first lamp and the second lamp are respectively driven by the second voltage signal and the third voltage signal.

15. The lamp driving system according to claim 14, wherein the first magnetic core is a bar-like magnetic core.

16. The lamp driving system according to claim 14, wherein the second magnetic core has an approximate C shape.

17. The lamp driving system according to claim 14, wherein the two ends of the second magnetic core have respective hollow parts, and the second magnetic core is combined with the first magnetic core via the hollow parts.

18. The lamp driving system according to claim 14, wherein the lamp is a discharge lamp.

19. The lamp driving system according to claim 18, wherein the discharge lamp is a cold cathode fluorescent lamp (CCFL).

* * * * *